US005170150A

United States Patent [19]

Austin et al.

[11] Patent Number: 5,170,150

[45] Date of Patent: Dec. 8, 1992

[54] PHOTOELECTRIC SMOKE DETECTOR WITH IMPROVED TESTING MEANS

[75] Inventors: Gregory J. Austin, Holland; Gaetano Ingrassia, West Olive, both of Mich.

[73] Assignee: Gentex Corporation, Zeeland, Mich.

[21] Appl. No.: 646,169

[22] Filed: Jan. 25, 1991

[51] Int. Cl.[5] ..... G08B 17/10

[52] U.S. Cl. ..... 340/630; 340/635; 340/515; 250/574; 356/338; 324/158 R

[58] Field of Search ..... 340/600, 630, 635, 515; 250/574 X; 356/338; 324/158 R, 158 T, 158 D

[56] References Cited

U.S. PATENT DOCUMENTS

| | | | |
|---|---|---|---|
| 4,099,178 | 7/1978 | Ranney et al. | 340/630 X |
| 4,166,698 | 9/1979 | Steele | 340/630 X |
| 4,374,329 | 2/1983 | Shoenfelder et al. | 340/630 X |

*Primary Examiner*—Jin F. Ng
*Assistant Examiner*—Jeffery A. Hofsass
*Attorney, Agent, or Firm*—Malcolm R. McKinnon

[57] ABSTRACT

An improved smoke detector incorporating means for verifying the detector's smoke sensitivity limits, such verification means including means for positively positioning various light reflecting surfaces to provide predetermined light reflection onto light sensing means to create simulated smoke levels.

2 Claims, 2 Drawing Sheets

FIG. 1
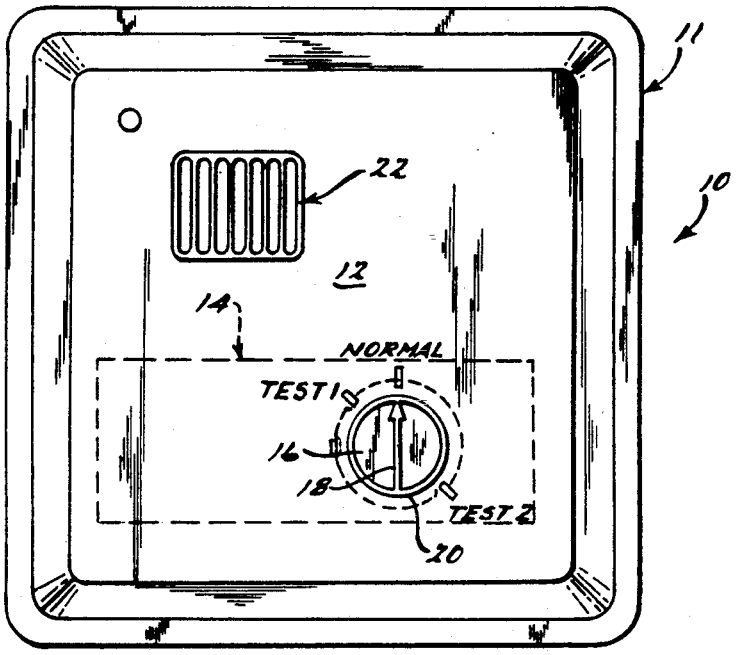
FIG. 2
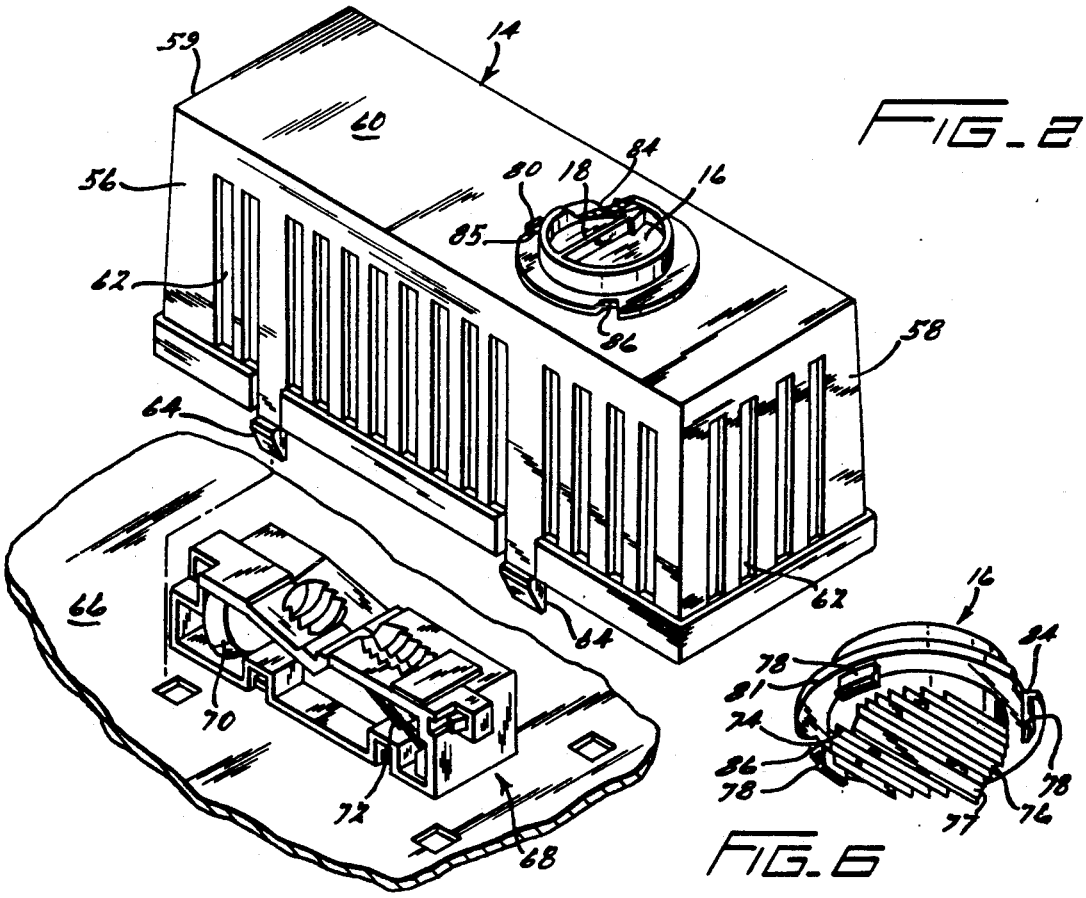
FIG. 6

PHOTOELECTRIC SMOKE DETECTOR WITH IMPROVED TESTING MEANS

BRIEF SUMMARY OF THE INVENTION

This invention relates to smoke detectors of the photoelectric type and, more particularly, to an improved photoelectric smoke detector incorporating improved testing means for verifying the detector's minimum and maximum sensitivity limits to insure optimum operation.

Heretofore, testing of photoelectric smoke detectors have been done in a number of different ways, including, in one form or another, a simulated smoke condition, or a simulated electrical condition, such as an auxiliary light condition or auxiliary voltage or current condition, or some other artificial condition that would have the effect of approximating, or substituting for, the real conditions of smoke under which a smoke detector of the indicated character would normally sound an alarm and also the absence of such conditions in which the smoke detector is expected to reliably perform by refraining from sounding any alarm. In many cases the provision of such additional test circuitry may complicate and therefore seriously compromise the existing sensing and alarm circuitry of the smoke detector. Also, in providing such prior art testing procedures for both alarm and no-alarm conditions, considerable effort and expense is required for "grafting" on to the existing circuitry whatever supplementary circuitry, lighting, and power sources are needed to implement such testing procedures. Further, the addition of such often complicated circuitry, whether optical or electrical or both, necessarily adds, not insignificantly, to the cost of such smoke detectors to the consumer.

Another test procedure employed by some past smoke detectors is to provide a reflection means which when positioned will direct the light source onto the sensing means to thereby simulate a smoke condition or various degrees of a smoke condition, depending upon the angle of reflection imparted to the reflector. While these types of smoke detectors avoid the disadvantages above-mentioned, they incur other problems such as requiring additional means separate from the smoke detector for manipulating the reflector to a test position, or they require that the entire housing be shifted or translated or rotated from one position in which it is intended to scatter the source light to another position in which it will provide the necessary angle of incidence required for testing. Through repeated use, however, reflectors of this type may become vulnerable to damage or breakage. Also, in some instances the same reflecting surface is used for normal operation as well as test operations, the angle of incidence being changed by deflecting the sole light scattering surface towards the sensing diode. It is quite possible, therefore, that these reflectors will not offer the same angle of incidence every time a test procedure is initiated, especially after continued use. Further, the light reflecting surfaces in such smoke detectors are often flat and without surface definition that would enhance reflection at specific angles of incidence.

It is important, therefore, that such testing procedures be available in a simple and reliable form for any well-constructed smoke detector, such as described herein, so that such smoke detectors may operate effectively and continuously over a long period of time. It is equally important that the cost of their provision not be prohibitive so that the smoke detector of the type described herein can be made readily available to the average homeowner, or mobile home owner (where such devices are required by Federal law), or to new home builders, or, in the case of the factory or industrial site, to the worker, maintenance technician, or office personnel.

An object of the present invention is to overcome the aforementioned as well as other disadvantages in prior smoke detectors of the indicated character and to provide an improved photoelectric smoke detector incorporating improved testing means for verifying the detector's minimum and maximum sensitivity limits to insure optimum operation.

Another object of the present invention is to provide an improved photoelectric smoke detector incorporating improved means for positioning light reflection means to provide correct light reflection onto light sensing means to create a simulated smoke level.

Another object of the present invention is to provide an improved smoke detector of the photoelectric type which utilizes a light source incorporated in the detector and used during its normal operation for the purpose of providing testing procedures for alarm and no-alarm conditions, that is, smoke and no-smoke conditions, without the need for any additional or artificial light source and without the need of compromising light scattering means provided for normal operation.

Another object of the present invention is to provide an improved photoelectric smoke detector in which an improved light reflecting means is precisely movable with respect to a fixed light source and which can be moved precisely to different positions for reflecting for testing purposes light from the light source onto light sensing means utilized during normal operation of the smoke detector.

Another object of the present invention is to provide an improved photoelectric smoke detector system in which an easily rotatable reflecting means is utilized for reflecting light from the light source of the smoke detector system for the purpose of presenting to the light emitted by the light source a plurality of structurally different light reflecting surfaces for providing discrete testing procedures embracing both maximum and minimum calibration settings for the detector.

Another object of the present invention is to provide an improved light reflecting means which can be manually manipulated to offer separate and distinct reflecting surfaces for, respectively, a maximum and a minimum calibration setting.

Another object of the present invention is to provide an improved testing means for a photoelectric smoke detector, which testing means incorporates improved torque control means which facilitates precise manual positioning of the testing means to specific angular positions.

Yet another object of the present invention is to provide improved testing means for a photoelectric smoke detecting system, which testing means is economical to manufacture and assemble, durable, efficient and reliable in operation.

The above as well as other objects and advantages of the present invention will become apparent from the following description, the appended claims and the accompanying drawings.

BRIEF DESCRIPTION OF THE DRAWINGS

FIG. 1 is a top plan view of a smoke detector embodying the present invention;

FIG. 2 is an exploded perspective view of the reflector cage and sensor optics incorporated in the smoke detector illustrated in FIG. 1;

FIG. 6 is a schematic perspective view of the angularly movable test knob incorporated in the improved testing means embodying the present invention.

DETAILED DESCRIPTION

Figure 3A:
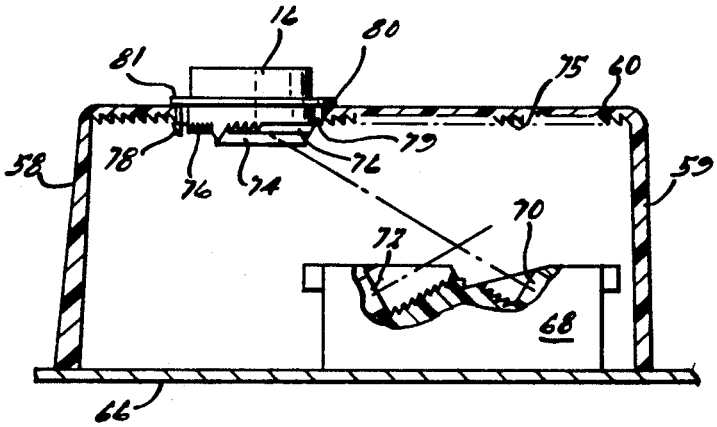
FIGS. 3A and 3B are schematic perspectives showing the testing means embodying the present invention in its "normal" setting.

Referring to the drawings, and more particularly to FIG. 1 thereof, there is shown in plan view a housing 10 for a smoke detector 11 having an improved testing means embodying the present invention. In the embodiment of the invention illustrated, the housing 10 is generally rectangular in plan view, although other configurations may be utilized if desired. The housing 10 has a suitable depth dimension for encasing all of the working components including suitable circuitry for the smoke detector, and the housing may be made of a plastic material known as NORYL N-190 available from General Electric Plastics Proprietary Ltd, 175 Hammond Rd. Dandenong Victoria, P.O. Box 776, Dandenong, 3175 Australia. Shown in phantom underlying the top wall 12 of the housing 10 is a light-scattering reflector cage 14 which is disposed within the housing 10 and which is also preferably made of NORYL N-190. Also shown in the drawings is a test reflector knob 16 comprising part of the improved testing means embodying the present invention, the knob 16 having an integral, transversely extending rib 18 which functions as an indicator and also enables the user to apply torque readily to the knob, the knob being mounted for angular movement in an opening provided in the top wall of the reflector cage 14 as will be described hereinafter in greater detail. The knob 16 is accessible by means of an opening 20 provided in the top wall of the housing. Such top wall 12 is also provided with three indicia lines or ridges indicating "normal", "test 1" and "test 2", the indicia being disposed around the perimeter of the opening 20 in spaced angular relationship. The test knob can be manually turned to any one of these three indicated positions for purposes to be described below. Also shown, on the top wall 12 of the housing 10 is a slotted area 22 which overlies alarm sounding means (not shown) incorporated in the smoke detector.

The main light reflector cage 14 is illustrated in FIGS. 2, 3A, 4A and 5A and is comprised of a pair of side walls 56, a pair of end walls 58 and 59 and a top wall 60. The end wall 58 and both side walls 56 are provided with slots 62, as shown, permitting the ambient atmosphere to circulate freely through the reflector cage. The cage 14 is further provided with suitable tab members 64 for securing the cage to a printed circuit board 66 which supports any desired electrical circuitry and other conventional components, such as an alarm, for the smoke detector, it being understood that the electrical circuitry forms no part of the present invention and may be of any desired or conventional design, as for example, circuitry of the type disclosed in U.S. Pat. Nos. 4,001,800 or 4,680,576 assigned to the assignee of the present invention. An optical housing 68 is provided which is also mounted on the circuit board 66, the optical housing containing a suitable light emitting source 70, such as a light emitting diode, and a light sensing means 72, such as a photocell or a photodiode.

Figure 3B:
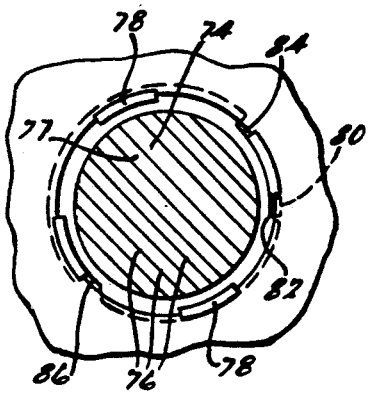

Referring now to FIGS. 3A and 3B, the test knob 16 is shown in its normal angular position, that is, the angular position in which the smoke detector is set to operate in its normal mode. In this case, most of the light from the light source 70 is scattered or kept away from the light sensing means 72 the conductivity of which varies according to the amount of light that impinges upon its light sensitive surface. Under smoke conditions, however, the light from the light source reflects off the smoke particles in the ambient air surrounding the sensing means and the increase in reflected light is then directed towards the sensing means, thus triggering a suitable alarm circuit such as disclosed in the aforementioned patents. As shown in FIG. 3A, the test knob 16 has formed on the bottom side thereof a series of parallel ribs 76, one of which, 74, is larger than the others. This single rib 74 is designed to reflect light to the light sensor 72 for a maximum calibration test, while the series of smaller ribs 76 are designed to reflect light to the light sensor for a minimum calibration test. The test knob 16 is retained in an aperture 79 provided in the top wall 60 of the cage 14 by means of lugs 78 depending from the periphery of the knob. The elasticity of the lugs allows them to be snapped into place so that they appropriately grip the periphery of the aperture 79 but at the same time allow the knob to be rotated within the aperture supported between the lugs 78 and the under surface of the rim 81 of the knob. In the normal setting of the test knob shown in FIG. 3A, the rib members 74 and 76 are off-set from the direction of light emanating from the light source 70 as shown in FIG. 3B so that any light that reaches the ribs from the light source 70 will be scattered away from the light sensor 72 in the same manner that such light is scattered by undulations 75 disposed on interior of the top wall 60 of cage 14. The test knob 16, therefore, does not interfere with the conventional scattering function of the interior of the cage 16. As shown in FIG. 3B notches 82, 84 and 86 are provided in the rim 81 of the knob, the notches being disposed in spaced angular relationship on the rim 81 of the test knob 16. In accordance with the present invention, the notches cooperate with a flexible tab 80, rectangular in cross section, formed integrally with the top wall 60 of the case 14, and located whereby the surface 85 thereof adjacent the aperture 79 is tangent to the edge of the aperture 79 and positioned to mate with the notches 82, 84 and 86 so as to hold the knob in the selected angularly adjusted position. By way of example, the flexible tab 80 may be approximately 0.030 inches thick, 0.100 inches wide and 0.062 inches high, the notches 82, 84 and 86 having a complementary configuration whereby the surfaces of the rim defining the notches are adapted to engage the tab 80 as shown in the drawings. The edges of the notches 82, 84 and 86 are preferably rounded at the corners as shown in the drawings to facilitate disengagement from the tab 80 when the knob is manually turned by means of the rib 18. The position shown in FIG. 3B, wherein the notch 82 is engaged by tab 80, corresponds to the normal position of the knob indicated in FIG. 1. The tab 80 is sufficiently thin that it flexes out of the associated notch when torque is applied to turn the knob to its next selected position, and since the tab 80 bends while the knob is moving to its next position, the frictional engagement of the inner surface of the tab with the rim of the knob provides the user with the feeling of a detent such as commonly provided in electrical switches, the friction being relieved when the tab moves into the next notch.

Figure 4A:
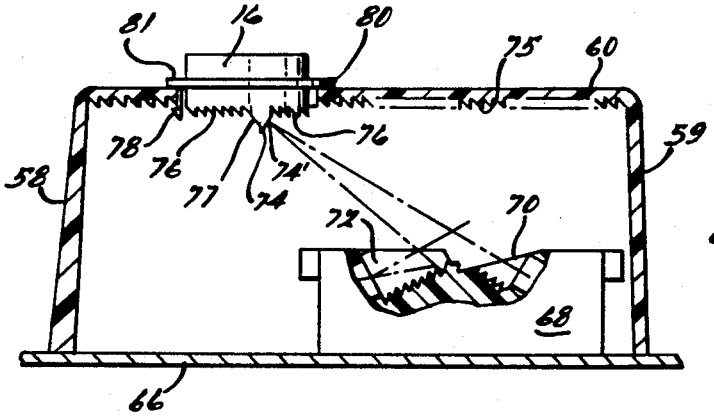
FIGS. 4A and 4B are schematic perspectives showing the testing means embodying the present invention in a first testing position.
Figure 4B:
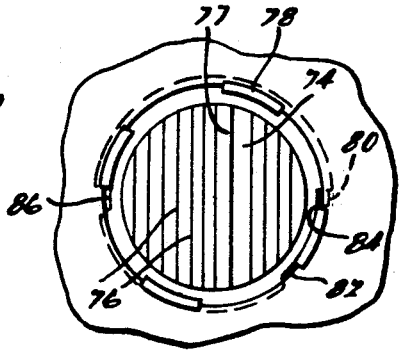

In FIGS. 4A and 4B the test knob 16 is shown positioned in a position wherein the single rib 74 has its face arranged at right angles to the direction of light emitted from the light source 70 as shown in FIG. 4B. In the embodiment of the invention illustrated, the face 74' of the rib 74 is formed at an angle of approximately 55 degrees so that the face 74' reflects a major portion of the light from the light source 70 to the light sensor 72 to thereby provide a signal from the sensor equivalent to the smoke detector's maximum calibration setting. During this test the detector should respond to a full alarm state. If not, it means that the detector's sensitivity has drifted out of its required lower limit and must therefore be re-calibrated. As shown in FIG. 4B, the notch 84 is engaged by the bendable tab 80, which corresponds to "test 1" (see FIG. 1).

Figure 5A:
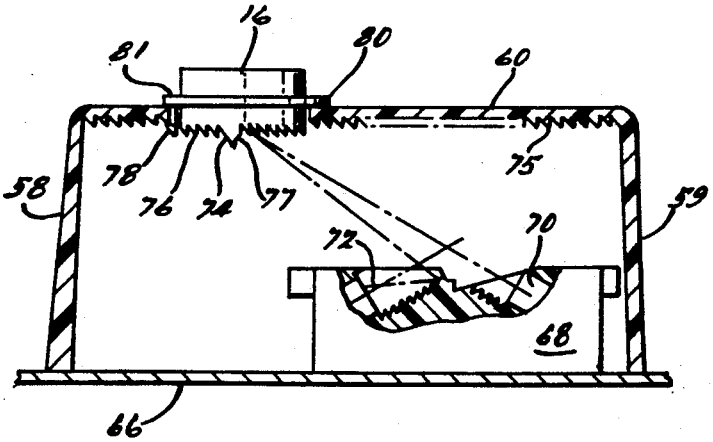
FIGS. 5A and 5B are schematic perspectives showing the testing means embodying the present invention in a second testing position.
Figure 5B:
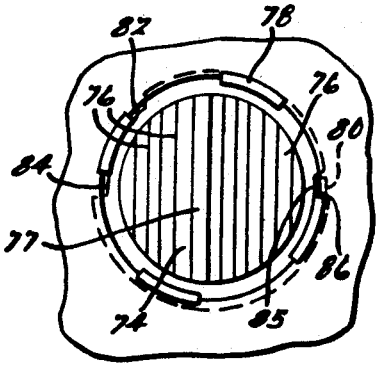

In FIGS. 5A and 5B the test knob 16 is shown positioned in the second test position in which the knob is moved angularly 180 degrees from the first position so that the ribs 74 and 76 are still at right angles to the direction of light emitted by the light source 70. In this position, however, the rib 74 has its opposing back face 77 facing towards the light source 70, the angle of the face 77 being significantly less than the angle of the face 74' so that any light striking the face 77 is directed downwardly and away from the light sensor 72 (see also FIG. 6). Because the remaining ribs 76 are formed on the knob with their faces at a 45 degree angle with respect to each other, only the tips or top edges on the ribs 76 reflect light from the light source back to the light sensor 72. Since there is less surface area on the ribs 76 to reflect light, there will be a concomitant smaller percentage of light reflected back to the light sensor 72. This low level of light corresponds to the level of the light seen by the light sensor 72 for its minimum calibration setting. If the smoke detector sounds its alarm during this test, it means that either dust or dirt has caused the detector's sensitivity to drift high and out of specification, or the detector is out of calibration and needs to be repaired.

While a preferred embodiment of the invention has been illustrated and described, it will be understood that various changes and modifications may be made without departing from the spirit of the invention.

What is claimed is:

1. In a smoke detector including light emitting means, light sensing means the conductivity of which varies as a function of the amount of light impinging thereon, and cage means surrounding said light emitting means and said sensing means whereby said sensing means is substantially sensitive only to light emitted by said light emitting means and reflected from airborne particulate matter in the atmosphere ambient in said cage means, the improvement comprising reflector means for testing the sensitivity limits of said sensing means, said reflector means including a major light reflecting means and a minor light reflecting means for reflecting light toward said sensing means, means rotatably mounting said reflector means in said cage means whereby said reflector means may be manually rotated to a first test position for presenting said major light reflecting means to said emitted light to thereby reflect a substantial amount of light to said sensing means and to a second test position for presenting said minor light reflecting means to said light emitting means to thereby reflect a lesser amount of light to said sensing means, and means including resilient tab means effective to position said reflector means precisely relative to said light emitting means and said light sensing means, said tab means being effective to apply a predetermined frictional resistance to torque applied to said rotatably mounted reflector means, said reflector means including a rim portion defining angularly spaced notches therein corresponding with predetermined angular positions of said reflecting means, the surfaces of said rim defining said notches cooperating with said tab means to position said reflecting means precisely with respect to said light emitting means and said light sensing means, whereby said reflector means may be rotated to an angular position wherein said major light reflecting means and said minor light reflecting means are substantially inoperative for reflecting light to said sensing means, said major light reflecting means comprising a single rib member and said minor light reflecting means comprising a series of rib members smaller than said single rib member and extending parallel to said single rib member.

2. The combination set forth in claim 1, wherein said single rib member presents an approximately 55 degree reflecting angle face to light emanating from said light emitting means, and said smaller rib members are arranged at an angle of approximately 45 degrees with respect to one another to thereby present only the tips of said smaller rib members to said light.

* * * * *